United States Patent [19]

Oscadal

[11] Patent Number: 4,904,846

[45] Date of Patent: Feb. 27, 1990

[54] OIL FILLED BODY HEATER

[76] Inventor: Augustin Oscadal, 29262 Union City Blvd., Union City, Calif. 94587

[21] Appl. No.: 187,865

[22] Filed: Apr. 29, 1988

[51] Int. Cl.[4] ..... F24H 7/00

[52] U.S. Cl. ..... 219/341; 219/365; 219/211; 219/528; 219/331; 237/16; 126/204

[58] Field of Search ..... 126/204, 205, 113; 237/16, 17, 18; 236/21 B; 219/211, 212, 330, 331, 332, 341, 365, 378, 528, 530, 540, 549

[56] References Cited

U.S. PATENT DOCUMENTS

| | | | |
|---|---|---|---|
| 2,034,800 | 3/1936 | Dougherty | 219/341 |
| 2,456,468 | 12/1948 | Theodore | 219/212 |
| 3,760,147 | 9/1973 | Tyrey | 219/330 X |
| 4,641,012 | 2/1987 | Roberts | 219/331 |

FOREIGN PATENT DOCUMENTS

| | | | |
|---|---|---|---|
| 1136031 | 9/1962 | Fed. Rep. of Germany | 219/334 |

*Primary Examiner*—Henry A. Bennet
*Assistant Examiner*—John M. Sollecito
*Attorney, Agent, or Firm*—Thomas M. Freiburger

[57] ABSTRACT

An electric heating device warms by radiation and convection. A metal casing holds a quantity of heat-conducting oil, with a remaining relatively small volume of space in the container evacuated of air and occupied by an inert gas under subatmospheric pressure. An electric resistance element in the lower part of the casing heats the oil and is positioned so that the oil circulates by thermal convection. An insulative jacket may be placed around the heater making the device capable of storing and giving off heat for relatively long periods of time.

4 Claims, 2 Drawing Sheets

OIL FILLED BODY HEATER

BACKGROUND OF THE INVENTION

The invention relates to heating apparatus, and more particularly to a radiator type heater capable of storing heat for relatively long periods of time.

A great number of heating devices, for various purposes, have been available. Electrical resistance heaters have been used for local heating of spaces, and these have included heaters with liquid convecting media inside a radiator-like structure.

Many types of devices have been known for storing and delivering heat gradually over a relatively long period of time, such as hot water bottles.

However, prior to the present invention, there was no conventional heater capable of the relatively short heat-up time, the high efficiency, relatively simple construction and relatively long heat storage and delivery time of the present invention described below.

SUMMARY OF THE INVENTION

The heating device of the present invention outperforms previous heater constructions by an efficient combination of features. The device is in the form of a metal radiator with internal circulating channels and containing a body of heat-conducting oil as a heat transfer fluid. An oil-immersible electric resistance heating element is positioned in a header at one end of the radiator body, near the bottom. The resistance heating element is positioned to effect an automatic circulation of the oil through the flow channels away from the heating element and back to the heating element, avoiding the need for any pump. Air is absent from the interior of the radiator body, having been evacuated and replaced with argon gas in a relatively small volume which remains above the oil. By preventing oxidation, this greatly extends the life of the heat transfer oil. The low pressure in the radiator also provides a safety feature, in that even when the unit is operating at maximum temperature, the pressure inside still remains below atmospheric.

In the filling of the heating device of the invention, the radiator vessel is filled to the appropriate level with the heat transfer oil. The electric resistance heating element is then powered until an external temperature probe indicates the appropriate temperature, which varies from about 300° F. to 600° F. depending on radiator configuration. Argon gas (or other substantially inert gas which will not react with the oil) is rushed into the filling hole, to the extent that the remaining air is substantially driven out through the filling hole, and then a plug is placed inserted to close the oil filling hole. As the oil cools, its volume decreases, while the argon gas also cools. A slight to moderate vacuum is created in the gas and the oil. At room temperature, the vacuum may be about negative 3.4 inches of water. In the operating range of the heating device, which may be about 195° F. to 210° F., the pressure of the contents still remains below atmospheric, and may be about negative 1.3 inches of water.

The invention therefore encompasses an effective overpressure safety check, since pressure inside the unit always remains below atmospheric, even at maximum operating temperature.

The heater of the invention preferably includes two further safety features. One is a thermostat microswitch in the power circuit, set at a high temperature which should never be exceeded, and requiring manual reset. The other is a pressure sensor switch, also in the power circuit, for shutting off power in the event pressure exceeds a selected maximum. This safety feature may become operative if, for example, the heater unit is turned over in use such that the heating element is in contact with the argon gas.

The use of the argon gas or other inert gas non-reactive with the heat transfer oil is an important feature of the invention. The heat transfer oil at elevated temperatures will oxidize fairly readily in the presence of oxygen, causing breakdown of the fluid and resulting in deposits which reduce thermal efficiency. The inert atmosphere prevents oxidation and effects an increase in long term efficiency of the unit.

The unit preferably comprises a pair of generally parallel header tubes joined by two or more low conduits. The heating element is positioned in one of the header tubes and is approximately half the length of the header tube in which it is inserted. The other header tube is at a greater vertical elevation than the header containing the heating element. When the element is energized, the decreased density of the oil at elevated temperatures surrounding the heating element causes the oil to migrate vertically and upwardly to displace denser colder fluid in the upper header. Cooler oil flows down the flow conduits farthest from the element, establishing a circulation patter, sometimes called a thermosiphon. This gravity-induced circulation avoids the need for a mechanical pump.

A cover or jacket may be placed over the heating unit, to partially insulate the unit from the environment and cause heat within the oil to be stored for longer periods of time and distributed gradually to the surrounding space. In the jacketed configuration, the unit can remain warm and continue to distribute heat to an environment somewhat below room temperature for about two to four hours, or up to about 10 hours in a bed, under coverings.

It is therefore among the objects of the invention to provide a simply constructed, highly efficient radiator type heating device having a long service life and a safety feature against overpressuring. These and other objects, advantages and features of the invention will be apparent from the following description of a preferred embodiment, considered along with the accompanying drawings.

DESCRIPTION OF THE DRAWINGS

FIG. 2 also indicates the direction of circulation of the heat transfer oil within the unit.

DESCRIPTION OF PREFERRED EMBODIMENTS

Figure 1:
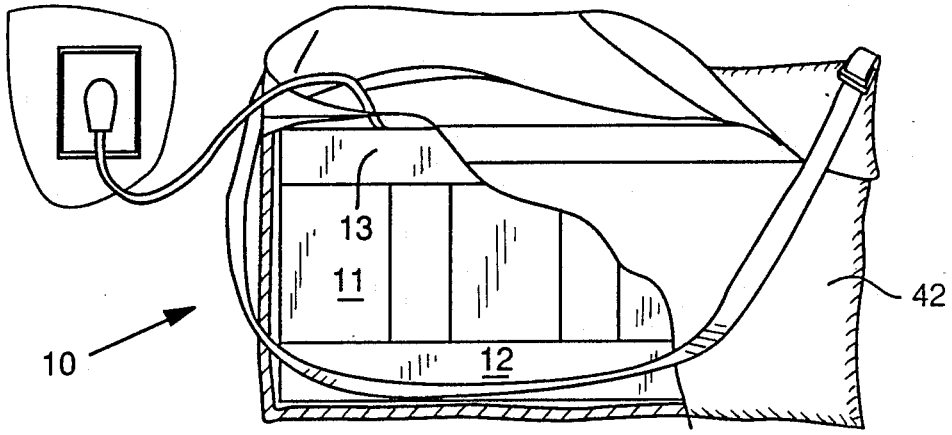
FIG. 1 is a perspective view showing one embodiment of a heating device in accordance with the invention, showing the exterior of the unit and a cover or jacket which can be used to enclose the unit.

In the drawings, FIGS. 1–4 show a heating device 10 constructed in accordance with the principles of the invention. The heating unit 10 includes a casing or housing 11, preferably of metal and comprising upper and lower headers 12 and 13 with connecting tubes or channels 14, 16 and 17 extending between the headers. The connecting channels, of which there may be three as shown, are spaced apart and provide conduits for convection of heated fluid within the housing or casing 11. All of the channels are fully open at both ends to the headers 12 and 13. The connecting channels 14, 16 and 17 maybe connected to the header tubes 12 and 13 by welding.

Contained within the heater casing 11 is a volume of heat transfer oil 18. The oil is of a type which has good heat transfer characteristics and which remains stable under relatively high temperatures, over long periods of time. For example, the oil used may be Chevron Heat Transfer Oil No. 1, Shell Thermia C or Mobil No. 601.

Figure 2:
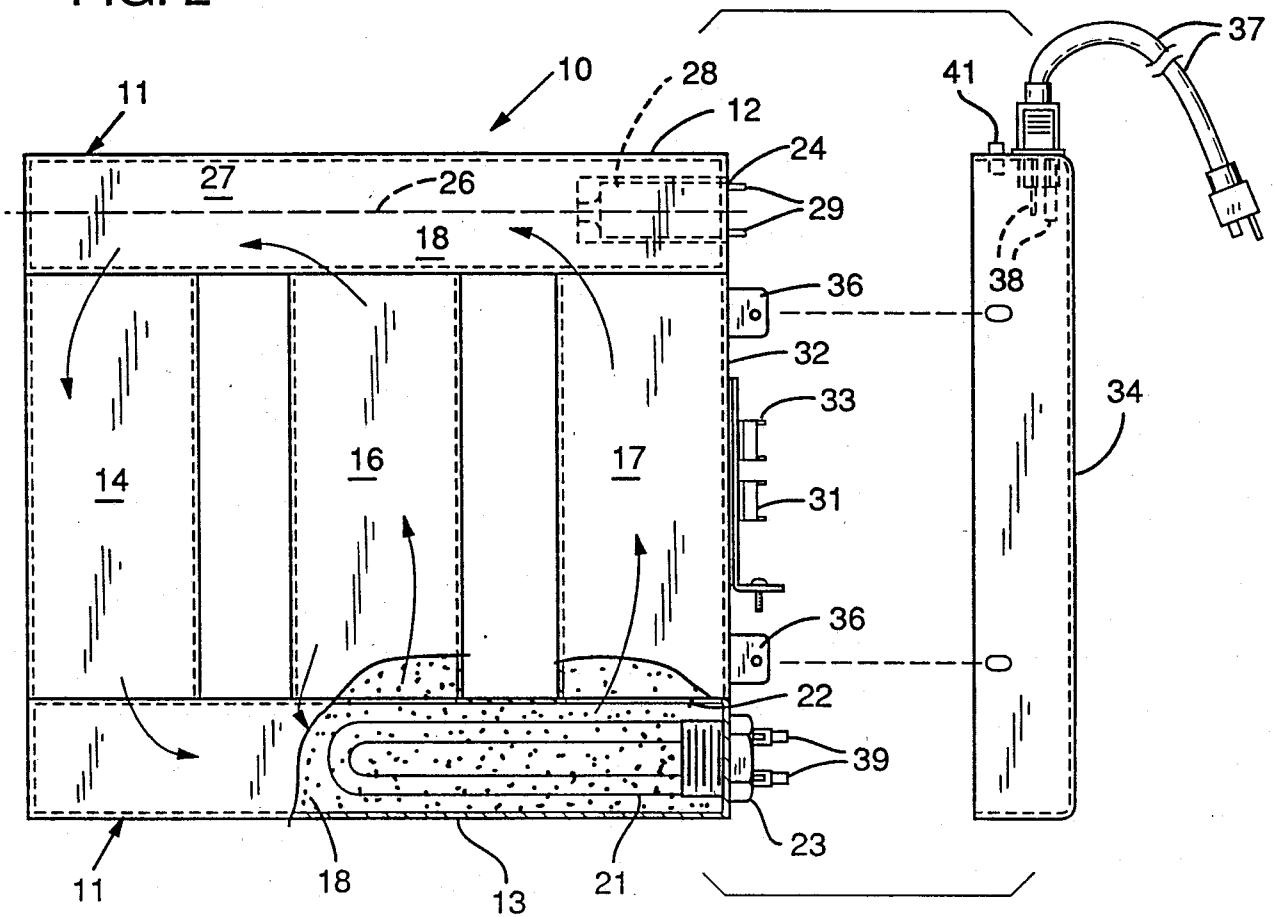
FIG. 2 is a schematic frontal elevation view showing the heating device, partially broken away to indicate an electric resistance element, heat transfer fluid and inert gas space inside the unit.

Contained within the lower header 13 of the casing, as shown in FIG. 2, preferably as close to the bottom of the casing as possible, is an electrical resistance heater unit or element 21. The resistance heater 21 may be secured in the housing 11 through an end wall 22 of the header 13 as shown, retained by a threaded connection 23 as indicated. The resistance heater 21 preferably is located toward one end of the header 13, so that convection of heated oil, heated by the resistance heater 21, can be in one general direction (counterclockwise as viewed in FIG. 2).

In the filling of the heater casing 11 with the oil 18, which may be via a plug 24 in one end of the upper header 12, the oil is filled up to a level 26 which is below the top of the casing. The oil is then heated to a temperature of 300° to 600° F., depending on the particular heating unit configuration. This may be by directly powering the resistance element 21 until the desired temperature is reached. As explained above, the remaining volume above the level 26 of the oil is then filled with an inert gas such as argon gas, which is substantially nonreactive with the oil, even at elevated temperatures. In the filling of the space 27 with such inert gas, air in the space is substantially totally purged out.

Figure 3:
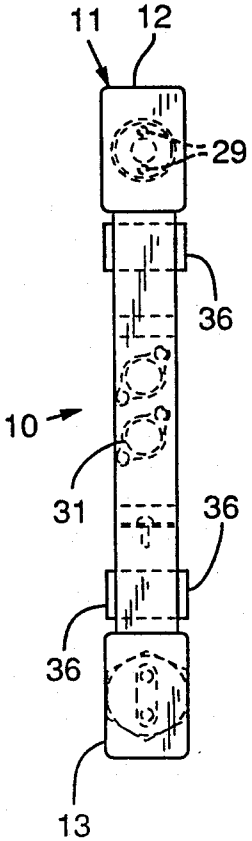
FIG. 3 is a somewhat schematic end elevation view of the unit shown in FIG. 2.

The plug opening 24 is then covered, and the plug used preferably includes a pressure sensor switch 28, indicated in FIGS. 2 and 3 in dashed lines. A low to moderate vacuum is created as the oil and particularly the gas cool.

The pressure sensor switch 28 has a pair of electrical leads 29 extending outwardly from the fluid volume. These leads 29 are connected in the power circuit of the heater unit, as further explained with reference to FIG. 4 below.

Also included on the heater device 10 is a thermostat switch 31, for maintaining an operating temperature which may be in the range of 150° F. minimum to 190° F. maximum, sensing temperature through a wall 32 as indicated.

In a preferred embodiment, the heater device of the invention also includes a thermostat microswitch 33 for shutting off power in the event a maximum safe temperature is exceeded, which may be about 320° F. This thermostat microswitch 33, which also senses temperature through the casing wall 32, provides a safety backup in the event of failure of the operating thermostat 31.

The purpose of the pressure sensor power switch 28, as explained previously, is to shut off power to the resistance heater 21 in the event of an increase in pressure beyond a preselected maximum. This might occur if the unit were inverted and used contrary to prescribed procedure, such that the inert gas were in contact with the resistance heater 21. In this event, the gas would expand due to direct heating by the resistance heater 21, without the convection which otherwise occurs, and the expanding gas would cause an increase in pressure.

In the preferred embodiment no elastomeric gaskets are used for sealing the oil and gas within the casing. Preferably Teflon is used for gasket sealing material at the plug opening 24 and at the connection 23 for the heating element.

As illustrated in the exploded view of FIG. 2, the heating device of the invention preferably includes a housing end cap or shell 34 which covers the principal electrical components and isolates them from the user and the surrounding environment. A power cord 37 is connected to the heater via the end shell, and has electrical leads 38 which are connected to the resistance heater 21 and the various switches 28, 31 and 33. Also, the housing preferably includes an indicator light 41 at a prominent position on the end shell 34 (such as on the top as illustrated), illuminated whenever current is actually flowing to energize the electrical resistance element 21.

The housing end shell 34, as illustrated in FIG. 2, preferably is connected to the remainder of the heater casing 11 via brackets 36 on the casing, and appropriate fasteners. Thus, all of the electrical components and associated conductor leads are covered in the assembled heater unit 10.

Figure 4:
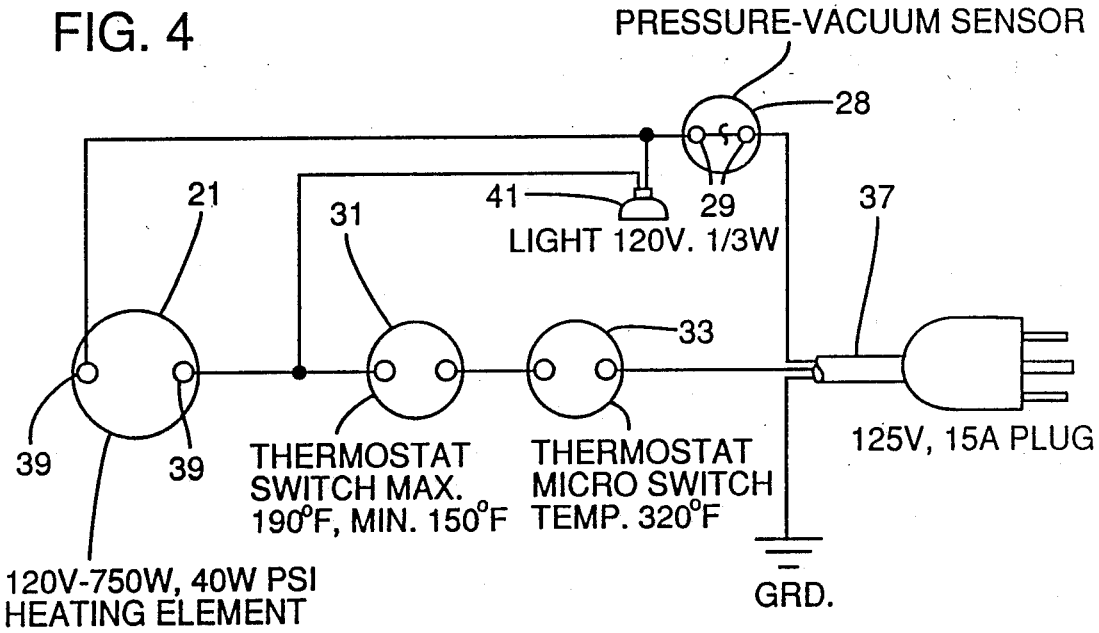
FIG. 4 is a schematic circuit drawing for the heating unit of the invention as illustrated in FIGS. 1–3.

FIG. 4 is a simple circuit diagram showing the connection of the electrical components associated with the heater 10. As indicated, a ground wire of the three-conductor power cord 37 is connected to ground. Another lead from the cord 37 goes to one conductor 29 of the pressure sensor switch 28. The other conductor 29 of the switch goes to one conductor 39 of the resistance heating element 21. The other side of the heating element is connected in series with the main operating thermostat 31, as illustrated. The thermostat is in turn connected in series with the safety override, high-temperature thermostat microswitch 33. The other side of this thermostat switch goes to the remaining lead in the power cord 37. As illustrated, the indicator lamp 41 is connected in parallel with the resistance heating element 21.

For an average-sized heating device 10 in accordance with the invention, with a fluid capacity of about two to three quarts (about 20" to 24" high), the electrical resistance heating element may be of about 750 Watts.

The heating unit of the invention, as discussed above, is capable of efficiently heating the heat transfer oil 18 and maintaining an elevated temperature without power for relatively long periods of time. A cover or jacket 42, shown in FIG. 1, may be used to cushion the otherwise hard surfaces of the casing 11 and to provide some insulation for even longer retention of and distribution of heat from the device. The heater unit with the jacket 42 may be "charged" by plugging it into power until the indicator light 41 goes off at which time the heat transfer oil has reached its operating temperature.

The unit may then be used as a foot warmer, as a bed warmer, placed under the bed or under the covers of the bed, as a warm seat for outdoor sporting events, or for any other use wherein a relatively limited area is to be heated.

The heater unit 10 shown in the drawings illustrates one configuration of a heating unit in accordance with the invention. Other configurations are also within the principles of the invention. For example, for under bed use the heater may be turned to a nearly horizontal position, with the connector conduits 14, 16 and 17 between headers longer in length. The upper header should have standoff legs for elevating it higher off the floor than the lower header, for proper convection of the oil and to keep the gas space isolated from the heating element, which is in the lower header.

The above described preferred embodiment is intended to illustrate the principles of the present invention, but not to limit its scope. Other embodiments and variations to this preferred embodiment will be apparent to those skilled in the art and may be made without departing from the scope of the invention as defined in the following claims.

I claim:

1. A heating device for storing and distributing heat for a period of time, comprising:

a radiator body having a hollow interior, and including a pair of spaced header tubes and at least two connector tubes extending generally transversely between the header tubes and communicating with the header tubes, a heat transfer liquid in the interior of the radiator body, substantially filling the header tubes and connector tubes except for a relatively small amount of volume of space above the heat transfer liquid, said relatively small volume of space being substantially free of air and substantially filled with a gas which is non-reactive chemically with the heat transfer liquid, even at the maximum operating temperature of the heating device, electrical resistance heating means within the radiator body, positioned so as to be covered with the heat transfer liquid and so as to promote thermal convection and circulation of the heat transfer liquid within the radiator body, without the need for a mechanical pump, an operating thermostat connected to the electrical resistance heating means, for causing the electrical resistance heating means to remain energized, when the device is connected to a source of power, until the temperature of the circulating heating liquid reaches a preselected maximum operating temperature, then for de-energizing the heating means until the temperature of the heating liquid drops below a preselected range, and an insulative jacket of fabric material, having one open end and sized for receiving the radiator body to enclose the radiator body and effect the storage of heat in the body for relatively long periods of time, with slow distribution of the heat to surrounding environment, and the heat transfer liquid and gas being at subatmospheric pressure and at a sufficiently low pressure that they remain below atmospheric pressure even at maximum operating temperature of the heating device, the radiator body being closed and isolated from the atmosphere.

2. The heating device of claim 1, further including high temperature thermostat switch means for shutting off power and requiring manual reset if the temperature of the heating liquid reaches a preselected high temperature significantly above the preselected maximum operating temperature.

3. The heating device of claim 2, further including pressure sensor switch means for shutting off power to the resistance heating means whenever direct contact occurs between the gas and the resistance heating means and pressure in the radiator body reaches a preselected pressure level as a result of such contact.

4. The heating device of claim 1, further including pressure sensor switch means for shutting off power to the resistance heating means whenever direct contact occurs between the gas and the resistance heating means and pressure in the radiator body reaches a preselected pressure level as a result of such contact.

* * * * *